United States Patent [19]

Gallart

[11] 4,358,946

[45] Nov. 16, 1982

[54] POWER TOOL

[76] Inventor: Robert Gallart, 107 Pershing Ave., Locust Valley, N.Y. 11560

[21] Appl. No.: 211,753

[22] Filed: Dec. 1, 1980

[51] Int. Cl.[3] ..... B21D 1/12; B25B 13/58

[52] U.S. Cl. ..... 72/392; 72/705; 72/481; 254/133 R; 81/180 B

[58] Field of Search ..... 72/392, 393, 479–482, 72/705; 81/3 R, 302, 180 R, 180 B, 180 D; 254/133; 269/282, 283

[56] References Cited

U.S. PATENT DOCUMENTS

| | | | |
|---|---|---|---|
| 788,962 | 5/1905 | Stoughton | 269/282 |
| 1,049,349 | 1/1913 | Fagerstrom | 81/180 D |
| 1,157,073 | 10/1915 | Baash | 72/392 |
| 2,042,936 | 6/1936 | Halin | 78/53.5 |
| 2,296,173 | 9/1942 | Mande | 81/15 |
| 2,341,278 | 2/1944 | Long | 153/32 |
| 2,443,931 | 6/1948 | Stultz | 153/33 |
| 2,447,401 | 8/1948 | Ferguson et al. | 81/15 |
| 2,497,836 | 2/1950 | Miller | 153/32 |
| 2,585,158 | 2/1952 | Morgenthaler | 81/15 |
| 2,588,509 | 3/1952 | Forster | 153/39 |
| 2,620,737 | 12/1953 | Miller | 103/163 |
| 2,643,562 | 6/1953 | Geddes | 81/15 |
| 2,690,323 | 9/1954 | Evenson | 254/104 |
| 3,292,903 | 12/1966 | Meyer et al. | 254/124 |
| 3,635,440 | 1/1972 | Van Gompel | 254/93 R |
| 3,817,079 | 6/1974 | Priester | 72/392 |
| 4,273,311 | 6/1981 | Rio | 72/705 |

FOREIGN PATENT DOCUMENTS

| | | | |
|---|---|---|---|
| 2358986 | 5/1975 | Fed. Rep. of Germany | 72/705 |
| 2616743 | 3/1977 | Fed. Rep. of Germany . | |

*Primary Examiner*—Lowell A. Larson

*Attorney, Agent, or Firm*—Kenneth E. Merklen

[57] ABSTRACT

Apparatus is provided which couples to one jaw of a pair of jaws of an expandable jaw power tool to remotely apply and distribute expansion power of the pair of power jaws when the jaws are actuated. A sleeve or collar is fitted over one of the jaws of the pair of power jaws, the sleeve adapted to receive and support one end of a threaded shaft, the other end of which supports a power or pressure distributing member. The threaded shaft screw-couples into a tapped hole in the sleeve and impinges upon one side of the jaw over which the sleeve is fitted, locking the sleeve on to the jaw. Thrust or expansion power, normally applied between the two jaws upon expansion, is applied between one jaw and the remote power or pressure distributing member coupled to the locked sleeve.

5 Claims, 13 Drawing Figures

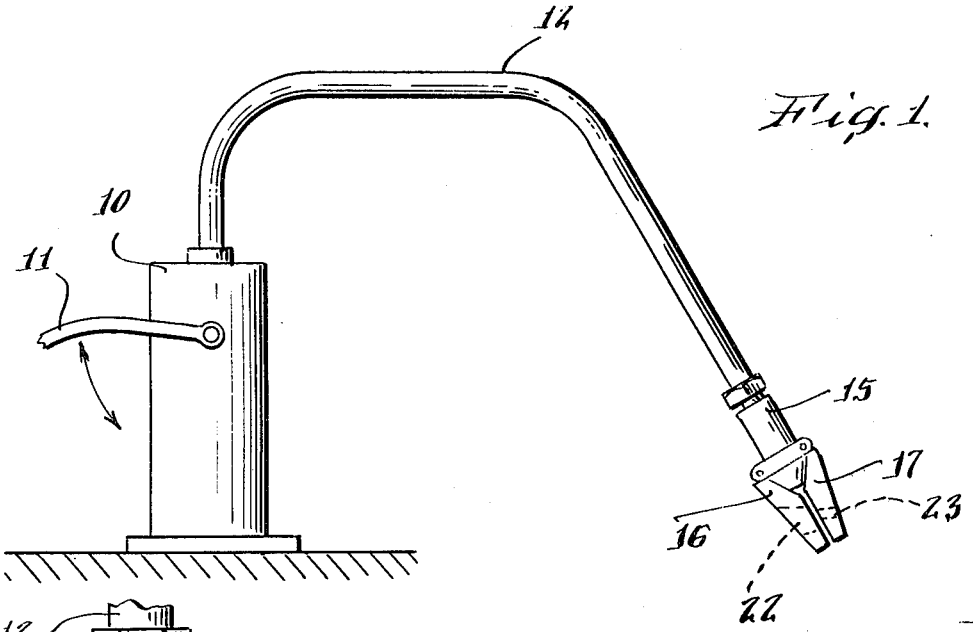
Fig. 1.
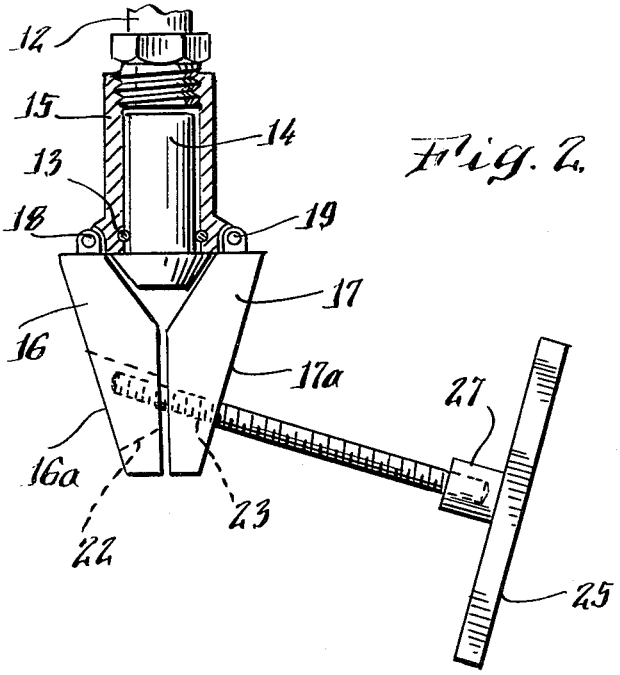
Fig. 2.
Fig. 2a
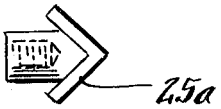
Fig. 2b.
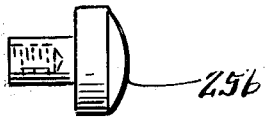
Fig. 2c.
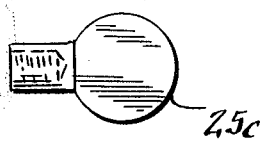
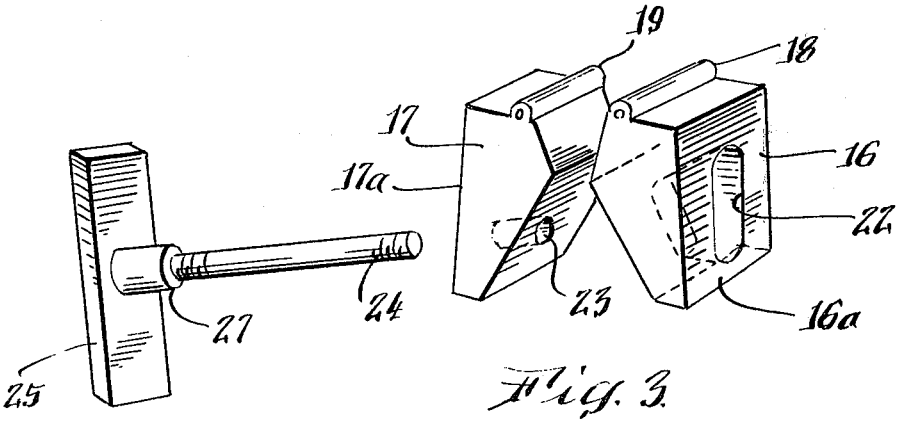
Fig. 3.

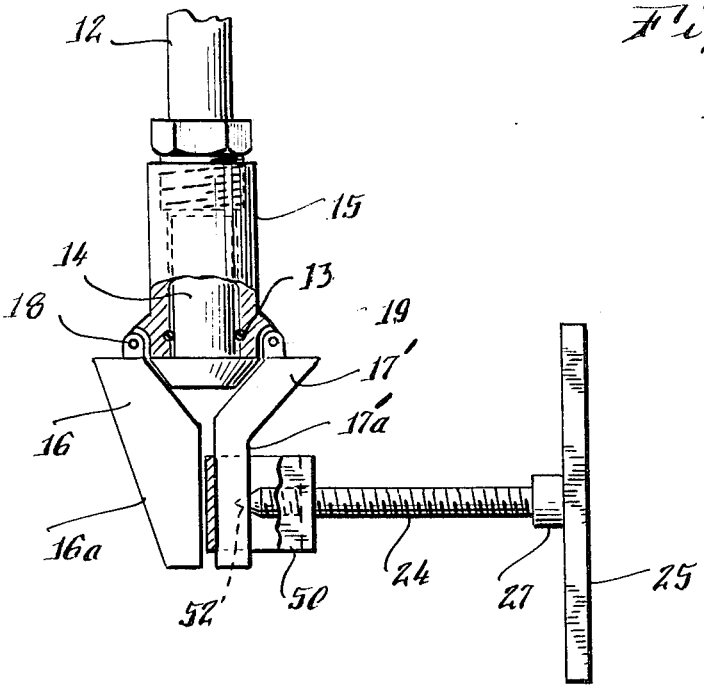
Fig. 7.
Fig. 8.
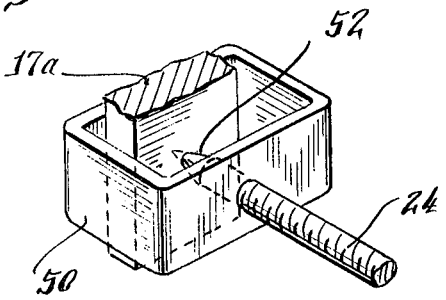
Fig. 9.
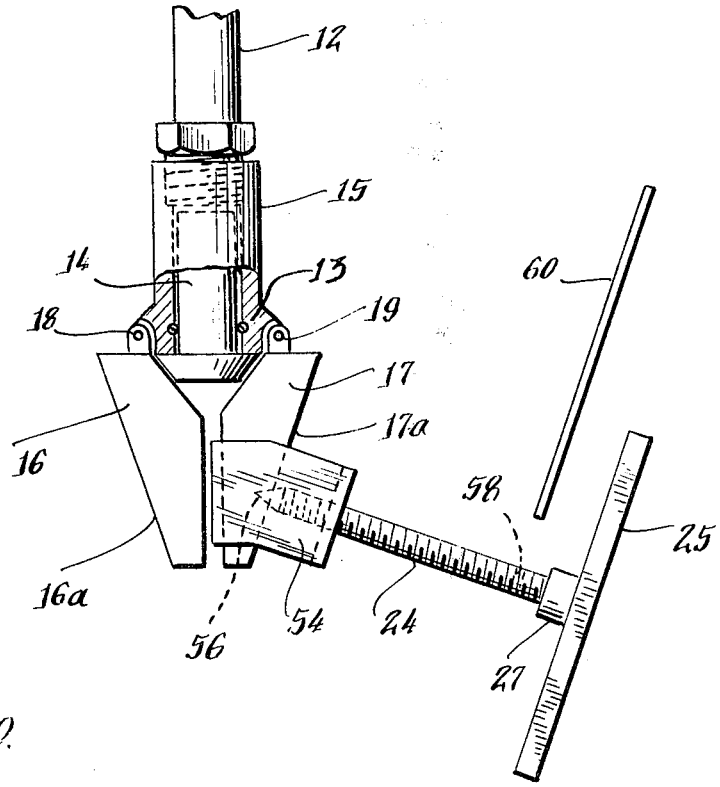
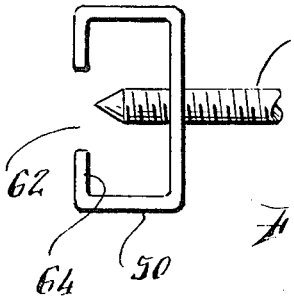
Fig. 10.

POWER TOOL

The present invention relates to an attachment tool usable in conjunction with an expandable jaw power tool, the like of which finds great utility in motor vehicle collision repair and particularly in straightening out dented metal surfaces of doors, panels, fenders, hoods and/or trunk lids and/or other metal surfaces on damaged motor vehicles.

PRIOR ART

Reference is made to my co-pending application filed on Feb. 21, 1979, titled Improved Power Tool, assigned Ser. No. 13,517, now U.S. Pat. No. 4,279,141, issued on 7/21/81.

The field of motor vehicle collision repair makes use of various methods for straightening or flattening metal surface of automobiles and other motor vehicles which have been damaged such as dented, bent and/or disfigured by collision or otherwise. One way to repair dented metal surfaces is to back the surface to be repaired with a block and hammer the surface thus simulating a hammer and anvil. This often requires two persons to do such job. In addition the hammered surface of the metal tends to stretch at and around the point of impact of the hammer. Another method of prior art is to put holes in the surface of the dented area and use a "pull-hammer" to straighten the surface. This method provides inserting a rod through the hole and clamping the rod on the back of the metal surface so that it does not pull through the metal. Then by using a sliding weight one can "pull-hammer" the metal to its original form. However, after the metal is straightened, the holes must be filled using a plastic or metal filler.

A more modern method is the use of expandable jaws, using pneumatic or hydraulic power to drive a piston between the pair of jaws to separate the jaws thereby expanding the jaws. This tool is used with a fair amount of success and ease in straightening bent, dented and/or twisted metal. However, due to the fact that the jaws are driven open by a solid piston and the work area, such as the door or other panel of an automobile is relatively small and narrow in the work area, and, since the tool must be portable, the jaws of the power tool are small and narrow and the area of the metal actually worked upon during straightening is very small. Thus, work is done, when using this tool, in small incremental steps. In addition, the distance from fully closed to full expansion of the pair of jaws is often not of sufficient travel to make contact with the inside surface of the interior panel of a vehicle door, for example, and the inside surface of the outside panel, being worked on so that a block is often required.

SUMMARY

The present invention is an attachment usable with a pair of power jaws which makes adjustable, both in area of application and width of application, the force the normally shallow-depth expandable jaws of a power tool apply so as to make the tool more useful and avoid the need of using a block. In addition, the present attachment when used with a pair of expandable jaws provides a remote backing surface or anvil effect of sufficient size so as to be effective as an interior anvil, remote from the power jaws when hammering of the exterior surface is required.

In one form of the invention one of the jaws of a pair of power jaws is fitted with a tapped hole to receive a threaded shaft. The other jaw of the pair of jaws is slotted so that the threaded shaft may float freely through the second of the jaws as the pair of jaws expand on their pivot points. The threaded shaft connects to a power transmitting member which applies the expansion power between the jaws over a larger work surface than normal. The power transmitting members coupled to the shaft may be in the form of a bar or disc connected as desired to the threaded shaft. The connection between the power transmitting member and the threaded shaft may be solid, such as a brazed or welded connection or may be a threaded connection which provides rotational adjustability or may be a clamp connection that accords universal adjustability between the threaded shaft and the power transmitting member. The threaded shaft screwed into the tapped hole of one jaw, with the ability to pass floatingly through the other jaw, via the slotted hole, provides remote application of the power stroke or expansion force of the pair of jaws.

In another embodiment, a sleeve or collar is provided which fits over one of the jaws of a pair of power jaws. The sleeve has a hole or port therein extending from the outer surface to the inner surface of the sleeve, opening on to the outer surface of the jaw over which the sleeve is fitted. The hole is tapped to receive a threaded shaft. When the sleeve is in position over one of the jaws the threaded shaft may be screw-coupled to the tapped hole and when the shaft is screwed into and through the tapped hole the end of the shaft will make contact with the surface of the jaw adjacent the hole. When screwed sufficiently into the hole the end of the threaded shaft will impinge upon the surface of the jaw and exert a locking pressure between sleeve and the back side of the jaw locking the sleeve on to the jaw of the power tool. The other end of the shaft may be fitted with a power transmitting or distributing member for remotely applying expansion power of the actuated power jaws.

When an attachment such as described is connected to at least one of the jaws of an expandable jaw power tool, the power tool becomes a more useful tool, becoming adjustable in depth so as to obtain increased range of use out of the expansion force while expanding the area over which such force may be applied. In addition, universal adjustability of the power transmitting member provides for selective application of the remotely transmitted power or pressure and, as additional feature provides a practical internal anvil.

OBJECTS

It is an object of the present invention to provide an attachment to an adjustable expandable jaw power tool.

Another object is to provide an expandable jaw power tool which, when provided with such attachment, is adjustable in remote application of the force developed.

Another object is to provide an improved expandable jaw power tool in which the effective expansion force of the jaws is extended over a larger surface area.

Still another object of the invention is to provide an attachment and for an expandable jaw power tool in which the power applicator is universally adjustable with respect to application of the force developed.

While another object is to provide an attachment for an expandable jaw power tool which may serve as an internal anvil for providing a base or backing for external hammering.

These and other objects, which may become apparent from reading the following description are found in a tool having primary utility in motor vehicle collision repair work but is not necessarily limited to such use.

BRIEF DESCRIPTION OF THE DRAWINGS

FIG. 1 represents an expandable jaw power tool;

FIG. 2 is a graphic representation of one embodiment of the present invention;

Figure 4:
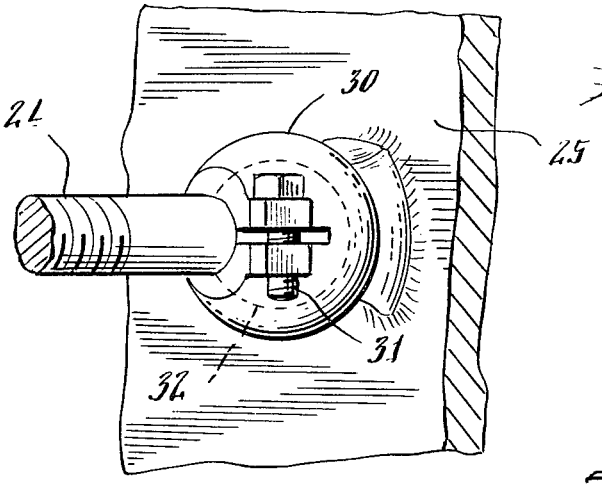
Figure 5:
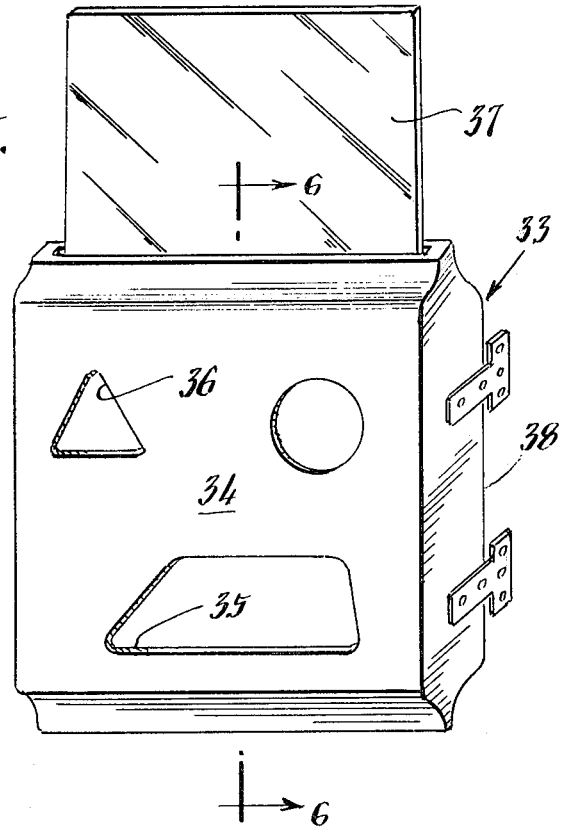
Figure 6:
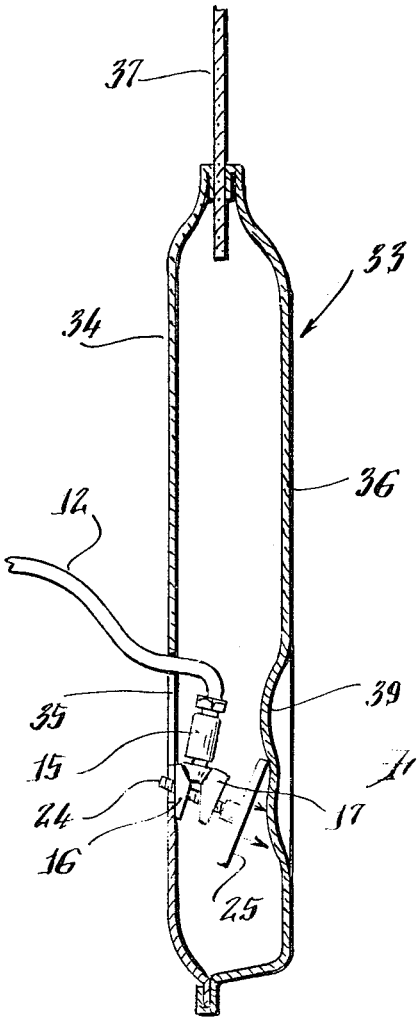

FIGS. *2a, 2b* and *2c* illustrate alternate structures or contours of the power distributing member;

FIG. 3 illustrates one form of the invention in exploded view;

FIG. 4 represents a universal coupling between a power transmitting member and a power distribution member;

FIG. 5 shows in graphic perspective an inside view of a motor vehicle door;

FIG. 6 is a view along line 6—6 of FIG. 5 of the internal part of a motor vehicle door with the present invention in use therein.

FIG. 7 is another embodiment of the invention showing a fitted sleeve over a jaw of a power tool and supporting a power relief member;

FIG. 8 is a view of the sleeve/shaft locking arrangement;

FIG. 9 illustrates another form of sleeve or collar; and

FIG. 10 represents a modified sleeve embodiment showing an open sleeve and threaded shaft combination which may be fitted over a jaw of a power tool.

DESCRIPTION OF INVENTION

FIG. 1 represents an expandable jaw power tool in which hydraulic power is generated in the pump 10, by actuation of the handle 11. The hdyraulic fluid is pumped through the hose 12 to the base of the piston 14 supported in the cylinder 15. The piston serves as a ram which is forced between the pair of jaws 16 and 17. The jaws are pivotally coupled to the top of the cylinder 15 by hinges 18 and 19 respectively. As the piston 14 is forced in between the jaws 16 and 17 the jaws are forced open applying an expanding force or pressure exerted from the outside of the jaws to anything in which the jaws come in contact. The cylinder may support a seal 13.

FIG. 2 represents a pair of power jaws, where jaw 17 has a threaded or tapped hole 23 and jaw 16 has a smooth wall slot 22, more clearly seen in FIG. 3. A threaded shaft 24 is screwed into the tapped hole 23 and, if screwed sufficiently far into the hole in jaw 17, may enter the slot 22 in jaw 16. The slot 22 is sufficiently large so that the shaft 24 may float in the slot 22. The slot 22 is elongated so that as the jaws 16 and 17 are separated by the advancing piston 14 the shaft 24 may float freely in the slot 22. The depth of the jaws 16 and 17 is seen as the distance from surface 16*a* to 17*a* when the jaws are not fitted with the attachment.

At the end of the shaft 24 is a force or pressure distribution member 25. This pressure distribution member may be fixedly attached to the end of shaft 24 as by welding or brazing the shaft 24 and the member 25 together. However, it is preferred that the power distribution member 25 be removable and thus a screw-coupling 27 is a more preferable connection.

The power distribution member 25 may be flat such as a plate or disc or may be in the form of a bar and may take any one of several contours such as shown in FIGS. *2a, 2b* and *2c* as 25*a*, an angle bar, 25*b*, a curved edge bar and 25*c*, a round shaped bar, respectively. Also, power distribution members of various length may be used, the length being suitable for the job, as desired, by merely substituting one for the other.

FIG. 4 illustrates a ball and socket or universal connection which is attached to the power distribution member 25. The socket 30 may be attached to the member 25 and the end of the shaft 24 may be inserted in the socket, the socket being closed about the shaft end by means of tightening the split socket with the bolt and nut combination 31/32. This type of coupling is particularly useful where universal adjustability and quick changeability is desired.

FIG. 5 illustrates a door of a motor vehicle as viewed from the inside where the interior decorative panel has been removed. Note that the access holes 35 and 36 on the inside panel 34 permit access to the interior of the door 33 while providing a backing for application of pressure. The hole 36 would serve to permit the crank (not shown) for the window 37 to pass through the inside panel 34 so as to permit operation of the window raising and lowering mechanism, not shown.

FIG. 6 illustrates how the invention may be used in straightening out a dented door. For purposes of illustration it is here assumed that the outside panel 38 of the door 33 was damaged. FIG. 6 shows in cross section the interior of the door 33, the outside panel being shown as 38, having the dented contour shown in section line 39 with the original contour shown in solid line. In order to straighten the outside panel 38 the present invention may be inserted into the interior of the door via access hole 35 and located so that jaw 16 abut the inside panel. The inside panel then serves as a block or stop for the jaw 16, providing a backing support. The power distribution member 25 coupled to jaw 17 via shaft 24 is positioned against the dented part of the outside panel 38 of the door. As the jaws 16/17 expand due to the piston 14 forcing the jaws apart, the expansion force between the separating jaws is applied between the jaw 16 and the power distribution member 25 to the outside panel at 39 which forces the dented portion of the door panel 39 back toward its original contour.

It can be seen that without the present invention a separate block would be required to serve as an auxiliary stop or block to reduce the working width of the interior of the door. This would require shifting the position of the jaws, while holding the block in place, as opposed to functionally increasing the working width of the jaws. Also, the area which the expansion force may be applied by use of the prior art jaws is small when compared to the area over which the expansion force is distributed by the present invention. It can be further seen that when the present invention is attached to the jaws as described the power distribution member may serve as an anvil located in the interior of the door which will permit further straightening of the panel through use of a hammer, for example.

FIG. 7 represents an alternate form of the invention where in a sleeve collar or fitting 50 is positioned over one of the jaws of a pair of power jaws 16–16*a*/17–17′*a* with the sleeve or collar 50 locked on to the jaws 17′ at 17′*a* by the threaded shaft 24 being driven into the surface of the jaw 17′*a* when the shaft 24 is screwed into the tapped hole in the sleeve or collar 50. The pointed end 52 is screw-driven into the surface of the jaw and exerts an expansion pressure between the sleeve 50 and the inside of the jaw 17'(17). The power distribution member 25 is coupled to the threaded shaft at fitting 27.

FIG. 8 more clearly shows the pointed end 52 of the threaded shaft 24 which when driven into the surface of the jaw aids in securing the sleeve to the jaw and provides added support for the power distribution member 25.

FIG. 7 illustrates that the jaw 17' may have a parallel lip 17'a as opposed to the angular shape illustrated by jaw 16/16a of FIG. 7.

FIG. 9 represents the angular shaped power jaws 16/16a and 17/17a with an angular or offset sleeve 54 supporting the threaded shaft 24 in a tapped hole with the point 56 pushing the sleeve away from the jaw 17a, locking into the surface of the jaw 17a and holding the back part of the sleeve tight to the inside of the jaw 17a. The power distributing member 25 may remotely apply the pressure exerted between the jaws 16 and 17 on the inside of a wall or spacing 60, normally inaccessable by use of the jaws alone.

The sleeves 50 and 54 may be in closed or encircling form or may be in open form, such as "C" shaped, for example, such as represented in FIG. 10. The inside of the collar 50 in FIG. 10, such as at 64 may be roughened or surrated so as to promote greater security between the jaw and the inside of the collar when the collar is forceably jointed to the jaw by the pushing of the shaft 24 against the jaw surface. The opening 62 may be narrow enough to form clamping ends for securing back, inside surface of the collar to the inside surface of the jaw while the roughened inside surfaces of the collar 50 at 64 aid in avoiding slippage when the pointed end 52 is driven into the surface of the jaw to secure the collar or sleeve 50 (54) on to the jaw 17/17a (17'/17'a).

If desired the sleeve may be in the form of a sock which may fit over the jaw, however, since pairs of jaws of a power tool may come in a variety of sizes a collar or sleeve as shown may fit on more than one size jaw of various sizes of power jaws.

By use of the structure as taught and described herein the expansion force or pressure of a pair of power jaws may be remotely applied, providing a more useful power tool. The invention has its preferred use in association with hydraulic or pneumatic power although the piston 14 may be forced between the jaws 16/17 by use of other forms of power.

Thus several embodiments of the present invention have been shown and/or described, without limitation thereto, along with one example of use which shows its several advantages over prior art.

What is claimed is:

1. Apparatus for remotely applying the expansion force generated between a pair of spreadable jaws of a spreadable jaw power tool said apparatus including:

a sleeve fitable around one jaw of said pair of spreadable jaws, a hole in said sleeve extending through said sleeve and communicating with the outer surface of the jaw around which said sleeve is fitted, said hole being tapped to receive and retain a threaded shaft, a threaded shaft screw coupled into said tapped hole and sufficiently long so as to make contact with the said outer surface of said jaw for forceable separating one inside surface of said sleeve from said outer surface of said jaw and for frictionally engaging another inside surface of said sleeve to another outer surface of said jaw for forceable locking said sleeve on to said jaw, and an expansion force distributing member coupled to the end of said threaded shaft opposite from that end of said shaft making contact with said jaw whereby said expansion force normally generated between said one jaw of said pair of jaws and the other jaw of said pair of jaws is applied between said other jaw and said expansion force distributing member.

2. Apparatus as in claim 1 and in which said sleeve is in the form of a collar surrounding part of said one jaw.

3. Apparatus as in claim 1 and in which said sleeve is open with fingers for gripping said another outer surface of said of one jaw when forceably locked on to said one jaw.

4. Apparatus as in claim 1 and in which said another inside surface of said sleeve which makes frictional engagement with said another outer surface of said one jaw is roughened for resisting slippage.

5. Apparatus as in claim 1 and in which said threaded shaft includes a conical end on the end of said shaft which makes contact with said outer surface of said jaw.

* * * * *